US008022326B2

(12) United States Patent
Yanai et al.

(10) Patent No.: US 8,022,326 B2
(45) Date of Patent: Sep. 20, 2011

(54) PUSH SWITCH

(75) Inventors: Yasunori Yanai, Okayama (JP); Yoshikazu Yagi, Okayama (JP)

(73) Assignee: Panasonic Corporation, Osaka (JP)

( * ) Notice: Subject to any disclaimer, the term of this patent is extended or adjusted under 35 U.S.C. 154(b) by 333 days.

(21) Appl. No.: 12/431,061

(22) Filed: Apr. 28, 2009

(65) Prior Publication Data

US 2009/0308725 A1 Dec. 17, 2009

(30) Foreign Application Priority Data

Jun. 13, 2008 (JP) ..... 2008-155028

(51) Int. Cl.
*H01H 5/18* (2006.01)

(52) U.S. Cl. ..... 200/406; 200/516

(58) Field of Classification Search ..... 200/406, 200/516, 284
See application file for complete search history.

(56) References Cited

U.S. PATENT DOCUMENTS 6,262,383 B1 7/2001 Nishikawa
7,022,928 B2 * 4/2006 Watanabe et al. ..... 200/406
7,525,059 B2 * 4/2009 Masuda et al. ..... 200/406
7,547,858 B2 * 6/2009 Nagata ..... 200/520
7,741,573 B2 * 6/2010 Masuda et al. ..... 200/406
2008/0035462 A1 2/2008 Yanai et al.

FOREIGN PATENT DOCUMENTS

CN 101123145 2/2008
JP 2007-329022 12/2007
JP 2008-041603 2/2008

* cited by examiner

*Primary Examiner* — Xuong Chung Trans
(74) *Attorney, Agent, or Firm* — Wenderoth, Lind & Ponack, L.L.P.

(57) ABSTRACT

A push switch includes an upper movable contact, a lower movable contact, a center fixed contact, an intermediate fixed contact, and a peripheral fixed contact. The lower movable contact includes an annular portion, and four legs extending from the annular portion. One of the four legs is placed on a peripheral fixed contact. The upper movable contact faces the center fixed contact through a circular hole in the annular portion of the lower movable contact via a space between the upper movable contact and the center fixed contact. Two legs out of the four legs are located away from each other by an angular interval smaller than 90 degrees with respect to the center of the annular portion. Upon being pressed, the actuator activates two combinations of switch contacts, one combination including the movable contacts and the intermediate fixed contact and the other combination including the movable contacts and the center fixed contact, providing the push switch with a small size.

9 Claims, 9 Drawing Sheets

PUSH SWITCH

FIELD OF THE INVENTION

The present invention relates to a push switch having switch contacts activated by a pressing operation and another switch contacts activated by a consecutive pressing operation.

BACKGROUND OF THE INVENTION

Electronic devices have been recently down-sized, and accordingly, components installed in the devices have been arranged densely. Push switches generating two-step click feel have been often used for actuating shutters of cameras, such as digital cameras and mobile telephones.

Japanese Patent Laid-Open Publication No. 2008-041603A discloses a conventional push switch generating the two-step click feel. This push switch is adapted to be mounted onto a circuit board, and includes a first movable contact and a second movable contact provided on the first movable contact. The first movable contact includes an annular portion having a circular hole provided in the center thereof, and four legs extending from the annular portion. The second movable contact is pressed down perpendicularly to the circuit board, and causes the first movable contact to elastically deform with a click feel so as to activate first switch contacts. Upon further being pressed down, the second movable contact elastically deforms with a click feel so as to activate second switch contacts. The push switch includes a case having a square shape as seen from above.

This push switch is activated by pressing perpendicularly to the circuit board. In the case that this push switch is installed in an electronic device, such as a digital camera or a mobile telephone, which is operated from a side of the device, this switch may prevents the side of the device from having a small size since the circuit board is arranged in parallel to the side.

Japanese Patent Laid-Open Publication No. 2007-329022 discloses another conventional push switch including switch contacts activated in a direction perpendicular to a direction in which a button moves. This push switch converts the direction of the movement of the button into the direction perpendicular to the direction of the button to activate the switch contacts.

SUMMARY OF THE INVENTION

A push switch includes an upper movable contact, a lower movable contact, a center fixed contact, an intermediate fixed contact, and a peripheral fixed contact. The lower movable contact includes an annular portion, and four legs extending from the annular portion. One of the four legs is placed on a peripheral fixed contact. The upper movable contact faces the center fixed contact through a circular hole in the annular portion of the lower movable contact via a space between the upper movable contact and the center fixed contact. Two legs out of the four legs are located away from each other by an angular interval smaller than 90 degrees with respect to the center of the annular portion.

Upon being pressed, the actuator activates two combinations of switch contacts, one combination of the movable contacts and the intermediate fixed contact and the other combination of the movable contacts and the center fixed contact, providing the push switch with a small size.

DETAILED DESCRIPTION OF PREFERRED EMBODIMENTS

Exemplary Embodiment 1

Figure 1A:
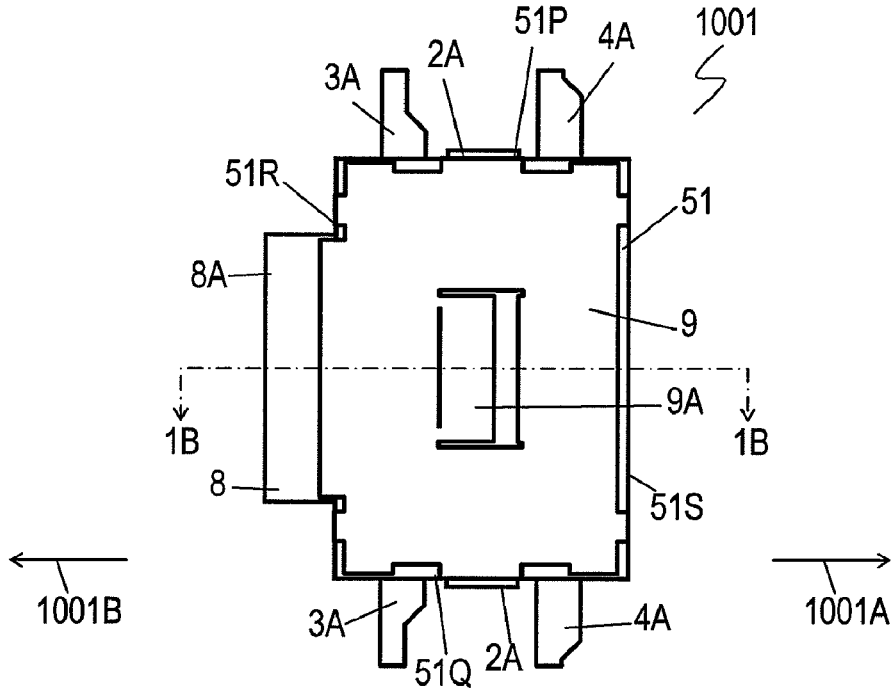
FIG. 1A is a top view of a push switch according to Exemplary Embodiment 1 of the present invention.
Figure 1B:
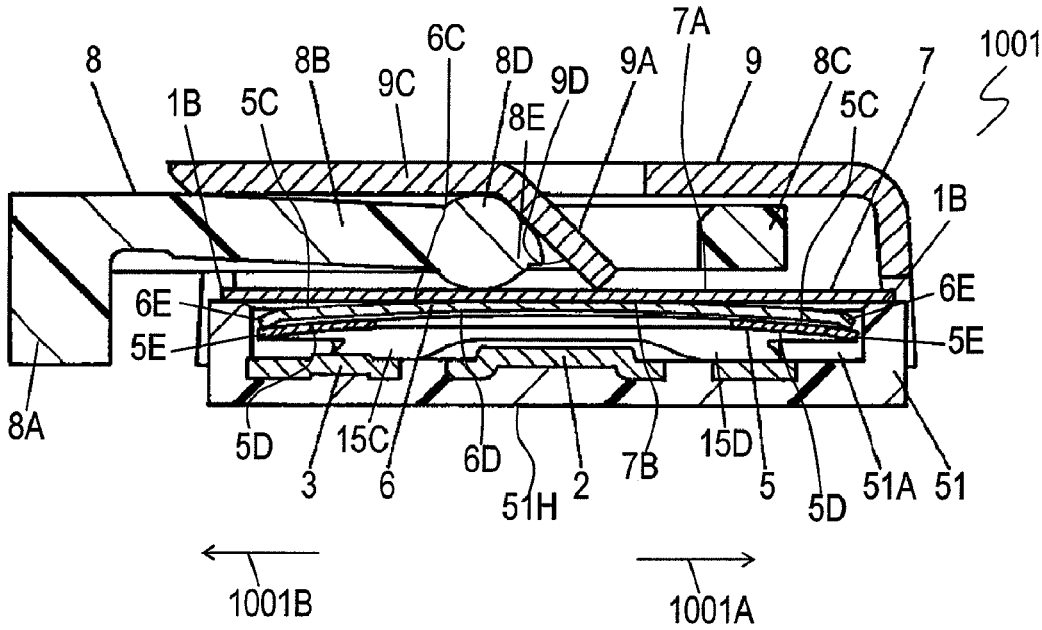
FIG. 1B is a cross sectional view of the push switch at line 1B-1B shown in FIG. 1A.
Figure 2:
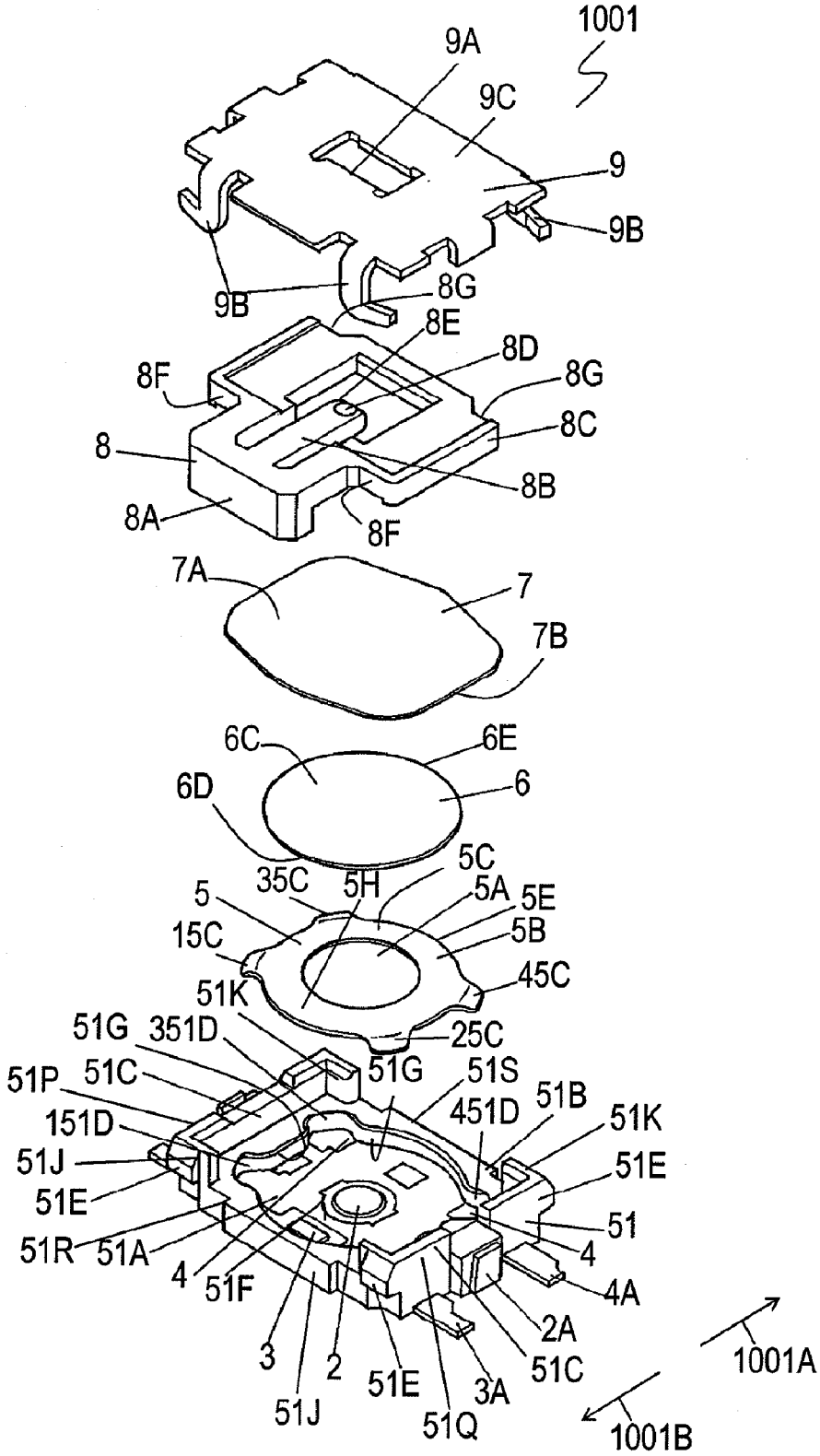
FIG. 2 is an exploded perspective view of the push switch according to Embodiment 1.
Figure 3:
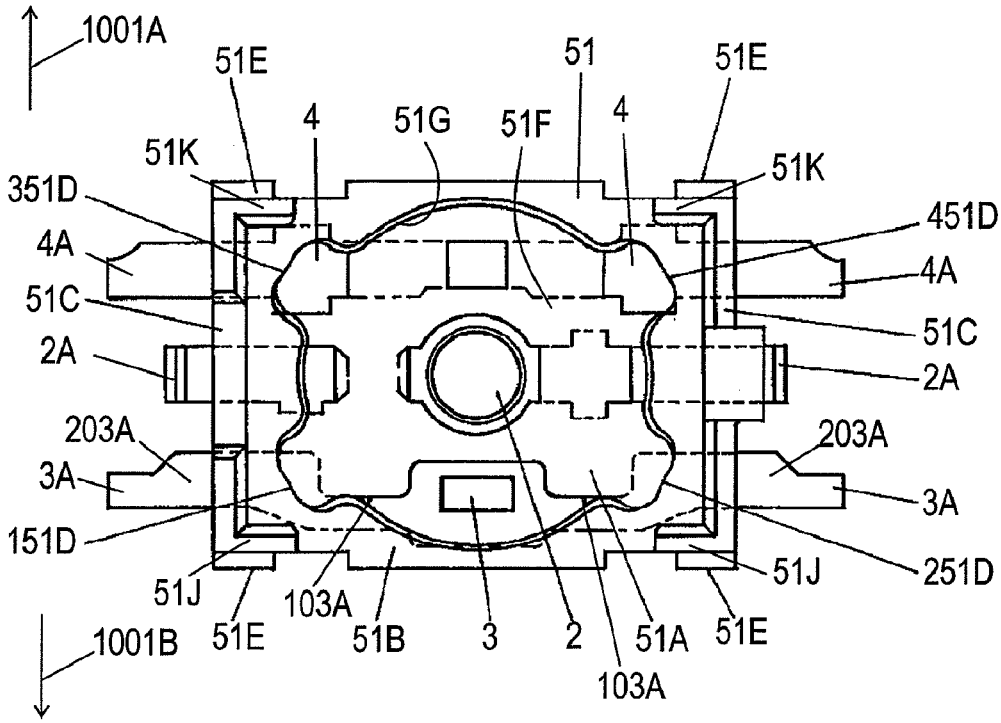
FIG. 3 is a top view of a case of the push switch according to Embodiment 1.
Figure 4A:
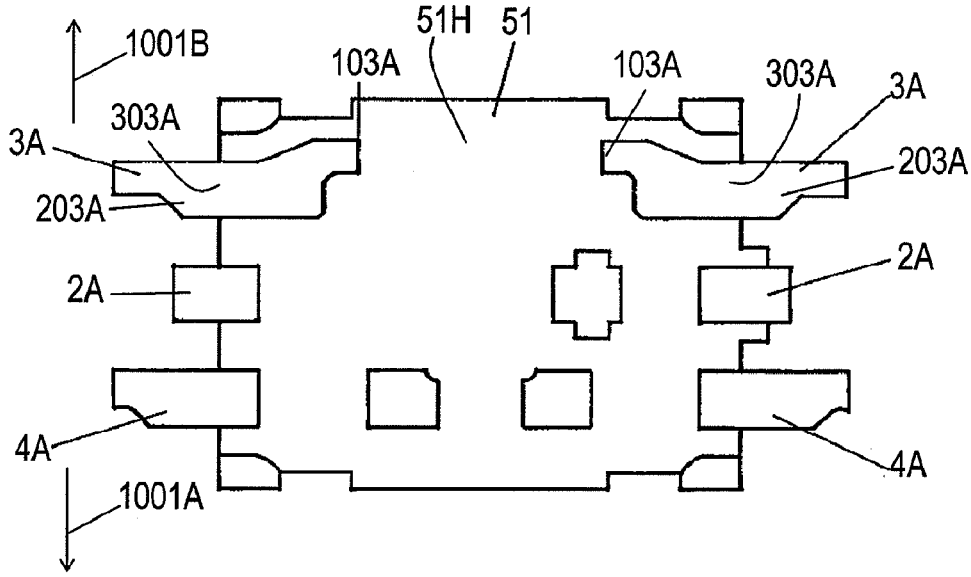
FIG. 4A is a bottom view of the case of the push switch according to Embodiment 1.

FIG. 1A is a top view of a push switch 1001 according to Exemplary Embodiment 1 of the present invention. FIG. 1B is a cross sectional view of the push switch 1001 at line 1B-1B shown in FIG. 1A. FIG. 2 is an exploded perspective view of the push switch 1001. The push switch 1001 includes a case 51 made of insulating resin. FIGS. 3 and 4A are a plan view and a bottom view of the case 51, respectively. The case 51 has a rectangular shape as seen from above, has short sides 51P and 51Q extending in parallel to direction 1001A, and has long sides 51R and 51S being longer than short sides 51P and 51Q and perpendicular to the short sides 51P and 51Q. The case 51 includes a flat region 5B facing upward. A recess 51A is provided in the flat region 51B, and has an inner side surface 51G connected with the flat region 51B and a bottom surface 51F joined to the inner side surface 51G. The bottom surface faces upward. The recess 51A, i.e., the bottom surface 51F has substantially a circular shape as seen from above. Two guide walls 51C protrude from both ends of the flat region 51B. Each of the guide walls 51C has a squared C-shape as seen from above. Pockets 151D, 251D, 351D, and 451D are provided in the inner side surface 51G of the recess 51A toward four corners of the rectangular shape of the case 51, respectively. The pockets 351D and 451D are located in the direction 1001A from the pockets 151D and 251D, respectively. A center fixed contact 2 located at the center of the circular shape, an intermediate fixed contact 3 located away from the center fixed contact 3, and two peripheral fixed contacts 4 are exposed on the bottom surface 51F of the recess 51A. The intermediate fixed contact 3 is located away from the center fixed contact 2 in a direction 1001B opposite to the direction 1001A and is located in the direction 1001B inside the recess 51A. The peripheral fixed contact 4 is located in the pockets 351D and 451D.

The fixed contacts 2, 3, and 4 are electrically insulated from each other. Terminals 2A and 3A connected to the fixed contacts 2 and 3, respectively, extend outward from the case 51 perpendicularly to the direction 1001A and in parallel with the bottom surface 51F of the recess 51A. A terminal 4A connected to the peripheral fixed contacts 4 extend outward from the case 51 perpendicularly to the direction 1001A and in parallel with the bottom surface 51F of the recess 51A. Lower surfaces of the terminals 2A, 3A, and 4A are flush with a lower surface 51H of the case 51.

As shown in FIG. 4A, the terminals 3A extend downward from both ends of the intermediate fixed contact 3 which is exposed from the bottom surface 51F of the recess 51A are exposed flush with the lower surface 51H of the case 51, and extend from the case 51 perpendicularly to the direction 1001A and in parallel with the bottom surface 51F of the recess 51A. That is, the terminals 3A include portions 103A and portions 203A. The portions 103A extend downward from the intermediate fixed contact 3 and are exposed from the lower surface 51H of the case 51. The portions 203A extend from the portions 103A and protrude from the case 51. The portions 203A of the terminals 3A have lower surfaces 303A flush with the lower surface 51H of the case 51.

A lower movable contact 5 is made of a thin elastic metal plate and includes an annular portion 5B and four legs 15C, 25C, 35C, and 45C extending downwardly and slantingly from an outer edge 5E of the annular portion 5B. The annular portion 5B has a ring shape having a circular hole 5A provided in the center thereof. The annular portion 5B has substantially a dome shape having an upper surface 5C having a convex shape protruding upward and a lower surface 5D having a concave shape. Outer edges of the four legs 15C, 25C, 35C, and 45C are connected smoothly via arcuate lines to the outer edge 5E of the annular portion 5B as seen from above. The lower movable contact 5 is accommodated in the recess 51A of the case 51 while the legs 15C, 25C, 35C, and 45C are positioned in the pockets 151D, 251D, 351D, and 451D in the inner side surface 51G of the recess 51A, respectively. The lower surface 5D of the annular portion 5B is spaced from the intermediate fixed contact 3 located directly beneath the annular portion 5B and faces the intermediate fixed contact 3. Lower ends of the legs 35C and 45C located in the pockets 351D and 451D are placed on the peripheral fixed contacts 4, respectively. The center fixed contact 2 is exposed upward through the circular hole 5A.

Figure 4B:
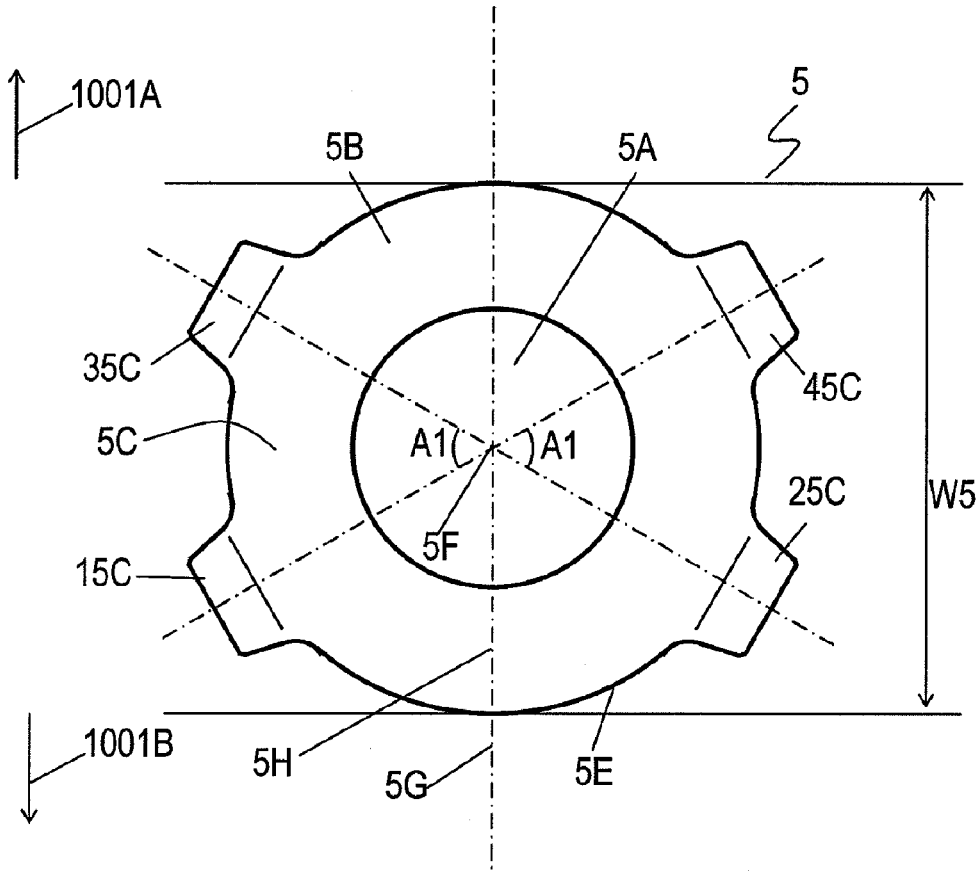
FIG. 4B is a top view of a movable contact of the push switch according to Embodiment 1.

FIG. 4B is a top view of the lower movable contact 5. The legs 15C and 45C are located symmetrically to each other with respect to the center 5F of the annular portion 5B as seen from above. The legs 25C and 35C are located symmetrically to each other with respect to the center 5F of the annular portion 5B as seen from above. The legs 15C and 25C are located symmetrically to each other with respect to the center axis 5G as seen from above. The center axis 5G passes through the center 5F in parallel with the direction 1001A. The legs 35C and 45C are located symmetrically to each other with respect to the center axis 5G. The legs 15C and 35C are located away from each other by an angular interval A1 about the center 5F. The angular interval A1 is smaller than 90 degrees and is larger than zero. Similarly, the legs 25C and 45C are located away from each other by the angular interval A1 about the center 5F. The legs 15C, 25C, 35C, and 45C are located within a width W5 of the annular portion 5B along the direction 1001A. This structure reduces lengths of the short sides 51P and 51Q, extending in the direction 1001A, of the case 51 having the lower movable contact 5 accommodated therein.

When a pressing force is applied from above to the annular portion 5B having the dome shape protruding upward, the legs 15C, 25C, 35C, and 45C warp. When the pressing force exceeds a predetermined level, the annular portion 5B is elastically reversed in shape with a click feel, so that the convex shape of the upper surface 5C changes into a concave shape, and the concave shape of the lower surface 5D changes into a convex shape. Then, upon the pressing force being released, the warping of the legs 15C, 25C, 35C, and 45C is released accordingly. When the pressing force becomes smaller than a predetermined level, the annular portion 5B returns back elastically with a click feel to have its original dome shape protruding upward.

The upper movable contact 6 is made of an elastic thin metal plate having substantially a dome shape having an upper surface 6C having a convex shape protruding upward and a lower surface 6D having a concave shape. The upper movable contact 6 is accommodated in the recess 51A of the case 51 and has a circular outer edge 6E. The outer edge 6E of the upper movable contact 6 is placed on the annular portion 5B of the lower movable contact 5, thus allowing the movable contacts 5 and 6 to be electrically connected to each other. An outer diameter of the upper movable contact 6 is equal to that of the annular portion 5B of the lower movable contact 5. The inner diameter of the circular shape of the recess 51A of the case 51 is slightly greater than both the outer diameters of the annular portion 5B of the lower movable contact 5 and the outer diameter of the upper movable contact 6, hence allowing the inner side surface 51G of the recess 51A to position the movable contacts 5 and 6 stably. The lower surface 6D of the upper movable contact 6 faces the center fixed contact 2 through the circular hole 5A in the center of the lower movable contact 5 and spaced by a distance from the center movable contact 2.

A pressing force is applied from above to the upper movable contact 6 having the dome shape protruding upward. When the pressing force exceeds a predetermined level, the upper movable contact 6 is elastically reversed in shape with a click feel so that the convex shape of the upper surface 6C changes into a concave shape, and the concave shape of the lower surface 6D changes into a convex shape. Then, when the pressing force is released and becomes lower than a predetermined level, the upper movable contact 6 returns back elastically with a click feel to have its original dome shape protruding upward.

A force for elastically reversing the shape of the lower movable contact 5 and a force for elastically returning to the dome shape of the lower movable contact 5 are smaller than those of the upper movable contact 6.

A protective sheet 7 made of insulating film having flexibility has a lower surface 7B bonded with adhesive onto the flat region 51B of the case 51 to seal the recess 51A accommodating the movable contacts 5 and 6 therein.

An actuator 8 made of insulating resin is movably provide on the upper surface 7A of the protective sheet 7 and sandwiched between the two guide walls 51C of the case 50. The actuator 8 includes an operating portion 8A extending in the direction 1001B outward from the case 51, an arm 8B extending in the direction 1001A from the operating portion 8A, a guide portion 8C extending in the direction 1001A from the operating portion 8A, and a pressing portion 8D provided at a distal end 8E of arm 8A along the direction 1001A. The guide portion 8C has a frame shape surrounding the arm 8B and spaced from the arm 8B. The arm 8B has flexibility. The pressing portion 8D has a spherical shape and slightly deviates in the direction 1001B from the center of the recess 51A of the case 51 as seen from above.

A cover 9 made of a metal plate has a top plate 9C having substantially a rectangular shape, an inclining portion 9A provided at the center of the top plate 9C, and four engaging portions 9B provided close to four corners of the rectangular shape of the top plate 9C. The inclining portion 9A inclines down from the top plate 9C by 45 degrees with respect to the direction 1001A, and has an inclining surface 9D facing the direction 1001B and extending downward. The cover 9 contacts upper ends of the guide portions 8C of the actuator 8 and covers the actuator 8. Four engaging portions 9B are engaged with four engaging projections 51E provided on outer surfaces of the guide walls 51C of the case 51, respectively, thereby fixing the cover 9 to the case 51.

The pressing portion 8D contacts the inclining surface 9D of the inclining portion 9A of the cover 9. End surfaces 8F of guide portions 8C facing the direction 1001B contact ends 51J of the guide walls 51C, respectively. The guide portion 8C of the actuator 8 is sandwiched between guide walls 51C and contacts the top plate 9C of cover 9. The pressing portion 8D contacts an upper surface 7A of the protective sheet 7. This arrangement allows the actuator 8 to be movable smoothly in the directions 1001A and 1001B while preventing the actuator 8 from being movable in directions perpendicular to the direction 1001A.

Figure 5:
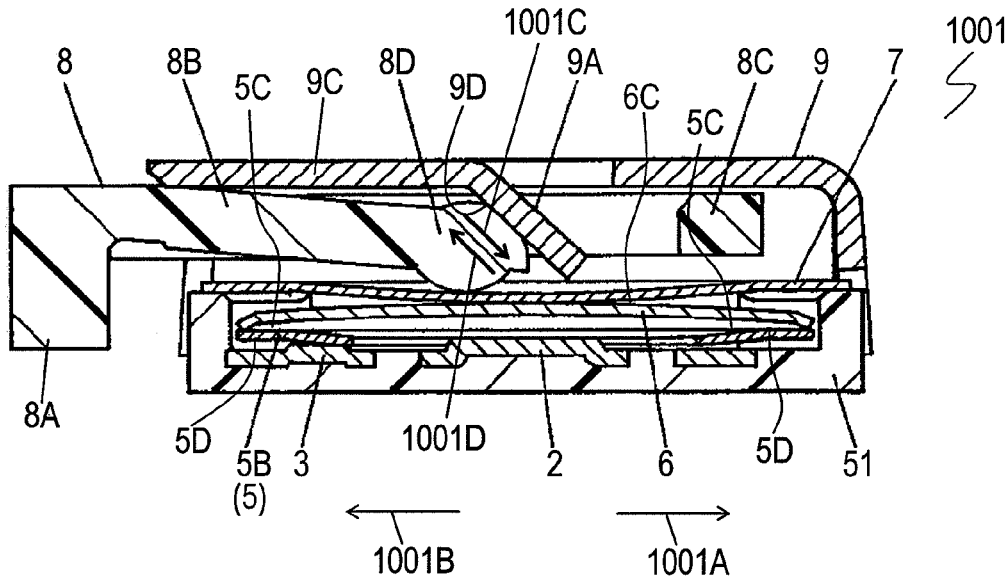
FIG. 5 is a cross sectional view of the push switch according to Embodiment 1 for illustrating an operation of the switch.
Figure 6:
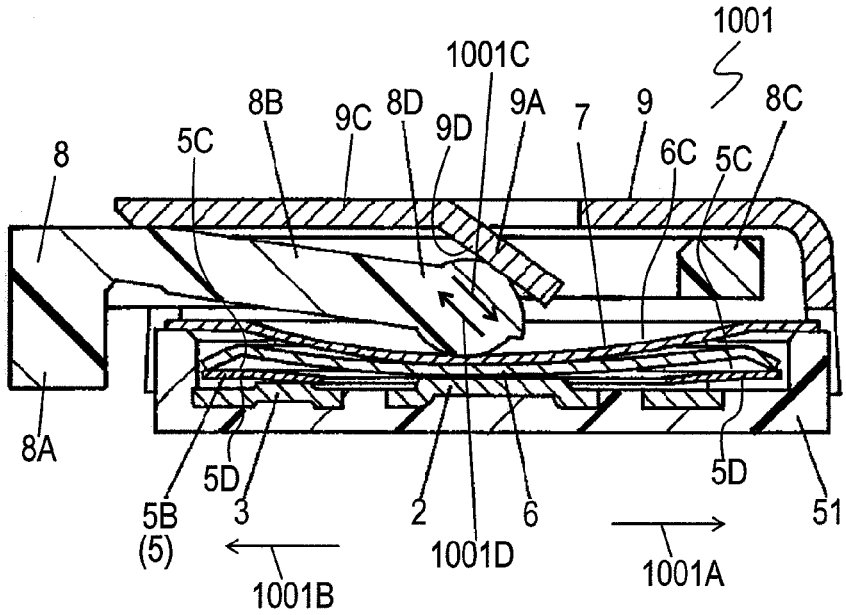
FIG. 6 is a cross sectional view of the push switch according to Embodiment 1 for illustrating an operation of the switch.

An operation of the push switch 1001 will be described below. FIGS. 5 and 6 are cross sectional views of the push switch 1001 for illustrating the operation.

Upon a pressing force being applied from the front to the operating portion 8A in the direction 1001A, the actuator 8 moves in the direction 1001A while the movement is restricted by the guide walls 51C of the case 51. As the actuator 8 moves, the arm 8B deflects, and the pressing portion 8D contacting the inclining portion 9A of the cover 9 moves along the inclining surface 9D in a direction 1001C extending downward by 45 degrees with respect to the direction 1001A, thus converting the pressing force in the direction 1001A into a downward pressing force directing downward.

Upon moving in the direction 1001C, the pressing portion 8D applies the downward pressing force to the upper surface 6C of the upper movable contact 6 via the protective sheet 7 and to the annular portion 5B of the lower movable contact 5 via the upper movable contact 6. As described above, the pressing force for elastically reversing the shape of the annular portion 5B of the lower movable contact 5 is smaller than that of the upper movable contact 6. When the downward pressing force exceeds a predetermined level, the annular portion 5B of the lower movable contact 5 is reversed elastically in shape with a click feel so that the dome shape of the annular portion 5B protrudes downward while the legs 15C, 25C, 35C, and 45C warp. That is, the concave shape of the lower surface 5D of the annular portion 5B changes into the convex shape protruding downward. This change of the shape causes the annular portion 5B to contact the intermediate fixed contact 3 facing the lower surface 5D of the annular portion 5B, and electrically connects between a first combination of switch contacts consisting of the lower movable contact 5 and the intermediate fixed contact 3 to turn on the first switch contacts, thus electrically connecting between the terminals 3A and 4A via the lower movable contact 5.

In the operation of the first combination of switch contacts, the pressing portion 8D of the actuator 8 moves downward and slantingly along the inclining portion 9A of the cover 9, thereby applying a force to press down the upper surface 6C of the upper movable contact 6 having the convex shape in the direction 1001C via the protective sheet 7. Hence, the force is applied mainly onto a portion 5H of the annular portion 5B of the lower movable contact 5 positioned in the direction 1001B shown in FIG. 4B. Since the intermediate fixed contact 3 is located directly beneath the portion 5H of the annular portion 5B in the recess 51A of the case 51, the intermediate fixed contact 3 securely contacts the portion 5H, accordingly contacting the lower movable contact 5 stably.

As the pressing force in the direction 1001A against the operating portion 8A is further increased consecutively to cause the downward pressing force from the pressing portion 8D to exceed a predetermined level, the dome shape of the upper movable contact 6 is reversed with a click feel, as shown in FIG. 6. That is, the convex shape of the upper surface 6C of the upper movable contact 6 changes into a concave shape while the concave shape of the lower surface 6D changes into a convex shape protruding downward. This change of the shape causes the upper movable contact 6 to contact the center fixed contact 2 facing the lower surface 6D of the upper movable contact 6, and causes electrical connection between a second combination of switch contacts consisting of the upper movable contact 6 and the center fixed contact 2 to turn on the second switch contacts, thus electrically connecting between all the terminals 2A, 3A, and 4A via the movable contacts 5 and 6.

When the upper movable contact 6 contacts the center fixed contact 2 to turn on the second combination of switch contacts, end 8G of the guide portion 8C of the actuator 8 facing in the direction 1001A contacts end 51K of the guide wall 51C of the case 51 in the direction 1001A, and prevents the actuator 8 from moving in the direction 1001A, thus stopping the actuator 8.

Then, as the pressing force applied to the operating portion 8A of the actuator 8 is released to decrease the downward pressing force applied to the upper movable contact 6 to a level smaller than a predetermined level, the upper movable contact 6 returns back to its original dome shape with a click feel due to its self-restoration force. That is, the shape of the upper surface 6C of the upper movable contact 6 changes into the convex shape protruding upward while the shape of the lower surface 6D changes into the concave shape. This removes the lower surface 6D of the upper movable contact 6 from the center fixed contact 2, thus electrically disconnecting and turn off the second combination of switch contacts. The pressing portion 8D of the actuator 8 is lifted up by the self-restoration force of the upper movable contact 6 via the protective sheet 7. Simultaneously to this, the pressing portion 8D is urged upward by the self-restoration force of the deflecting arm 8B. Accordingly, the pressing portion 8D moves upward and slantingly along the inclining surface 9D of the cover 9 in the direction 1001D opposite to the direction 1001C, thus allowing the actuator 8 to return back in the direction 1001B.

As the pressing force applied to the operating portion 8A is further decreased, the annular portion 5B of the lower movable contact 5 returns back with a click feel to its original dome shape due to the self-restoration force while the legs 15C, 25C, 35C, and 45C have their original shapes. This removes the lower surface 5D of the annular portion 5B from the intermediate fixed contact 3, thus electrically disconnecting and turning off the first combination of switch contacts. The pressing portion 8D of the actuator 8 is lifted up by the self-restoration force of the lower movable contact 5 via the protective sheet 7. Simultaneously to this, the pressing portion 8D is urged upward by the self-restoration force of the deflecting arm 8B. Accordingly, the pressing portion 8D moves upward and slantingly along the inclining surface 9D of the cover 9 in the direction 1001D opposite to the direction 1001C, thus allowing the actuator 8 to return back in the direction 1001B. The end 8F of guide portion 8C of the actuator 8 returns back to contact the end 51J of guide wall 51C of the case 51 in the direction 1001B, thus allowing the switch 1001 to return back to the status shown in FIG. 1B.

The conventional push switch disclosed in Japanese Patent Laid-Open Publication No. 2008-041603 includes a case having a square shape as seen from above, hence being prevented from having a small depth in the direction of pressing the button even if it is combined with the push switch disclosed in Japanese Patent Laid-Open Publication No. 2007-329022.

In the push switch 1001 according to Embodiment 1, the legs 15C, 25C, 35C, and 45C of the lower movable contact 5 are located within the width W5 of the annular portion 5B along the direction 1001A. Moreover, the outer diameter of the upper movable contact 6 is equal to that of the annular portion 5B of the lower movable contact 5. This arrangement can reduce the lengths of the short sides 51P and 51Q of the case 51 along the direction 1001A in which the operating portion 8A moves, thus reducing the depth of the push switch 1001 to decrease an installation area for surface-mounting the switch.

As described above, the terminals 3A extending from both sides of the intermediate fixed contact 3 exposed on the bottom surface 51F of the recess 51A of the case 51 are flush with the lower surface 51H of the case 51 and extend outward from the case 51 perpendicularly to the direction 1001A and in parallel with the bottom surface 51H of the recess 51A. In the case that the push switch 1001 is to be surface-mounted onto a circuit board by soldering the lower surface 51H of the case 51, the terminals 3A are joined securely onto a large area, accordingly joining the push switch 1001 to the circuit board with a large physical strength. As shown in FIG. 3, the recess 51A is positioned substantially at the center of the case 51. The intermediate fixed contact 3 deviates in the direction 1001B from the center fixed contact 2 located at the center of the recess 51A, but is located at the center of the case 51 along the direction perpendicular to the directions 1001A and 1001B. The terminals 2A to 4A are soldered to the circuit board. Each terminal 3A is closer to the operating portion 8A of the actuator 8 than either of the terminals 2A and 4A is. The operating portion 8A receives the pressing force during the operation of the push switch 1001. The terminals 3A located closest to the operating portion 8A are soldered on the large area of the circuit board, hence preventing the push switch 1001 from being removed from the circuit board even if an excessive pressing force is applied to the operating portion 8A.

The angular interval A1 about the center 5F between the legs 15C, 25C, 35C, and 45C of the lower movable contact 5 is preferably as wide as possible within the width W5 along the direction 1001A. The number of the legs is not limited to four.

In the push switch 1001, the peripheral fixed contacts 4 are exposed in the pockets 351D and 451D on the bottom surface 51F of the recess 51A of the case 51. Alternatively, the peripheral fixed contact 4 of the push switch 1001 according to Embodiment 1 may be exposed in one of the pockets 351D and 451D but not in the other of the pockets.

Exemplary Embodiment 2

Figure 7A:
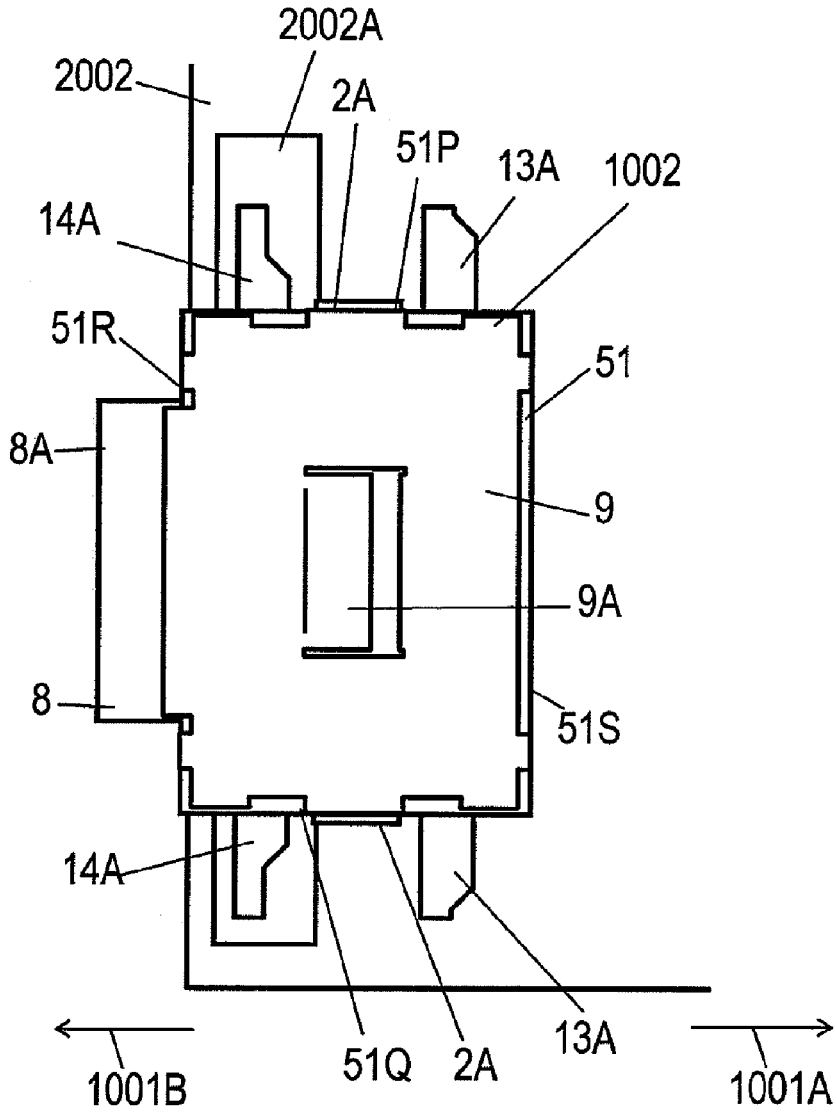
FIG. 7A is a top view of a push switch according to Exemplary Embodiment 2 of the invention.
Figure 7B:
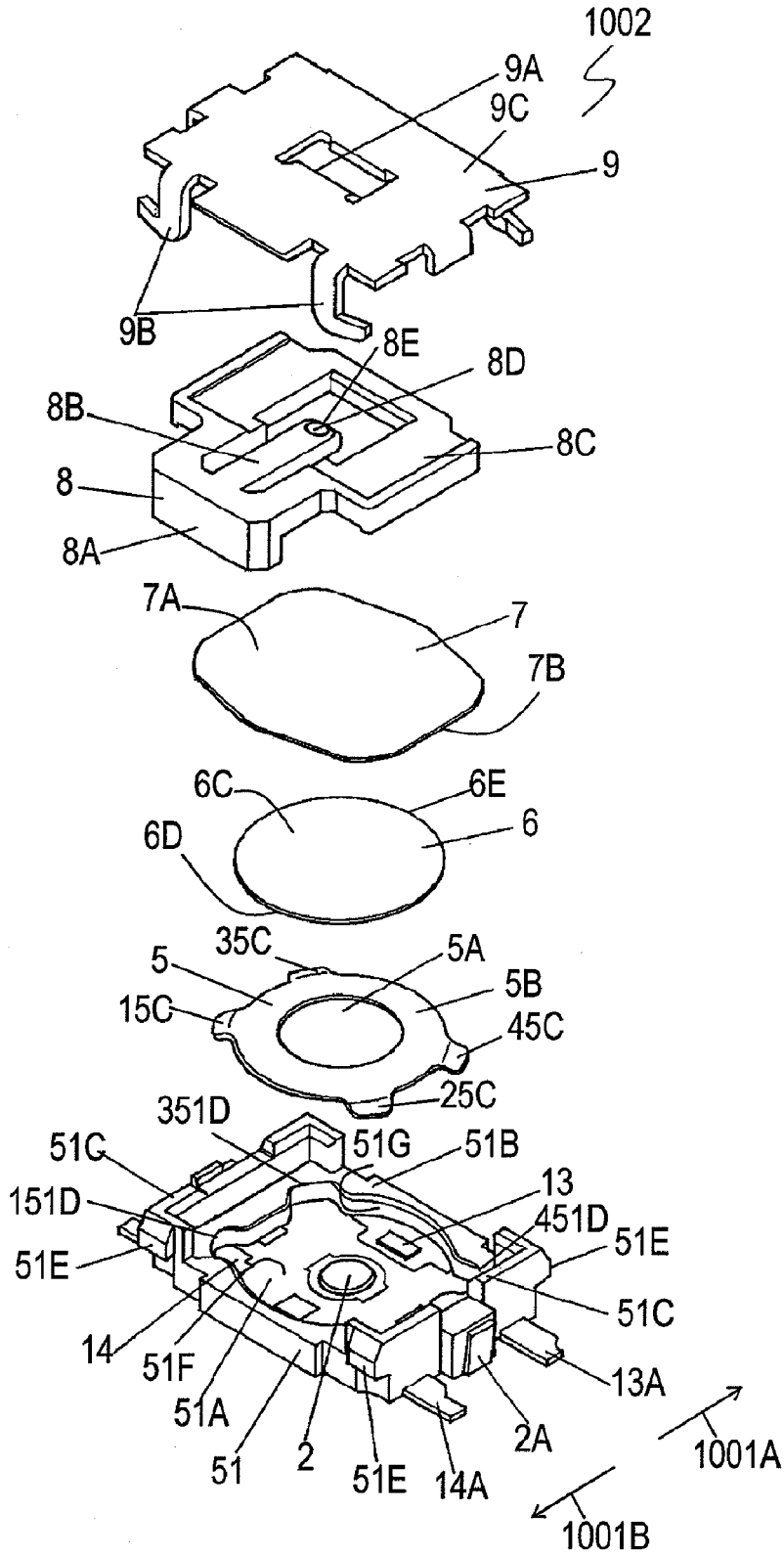
FIG. 7B is an exploded perspective view of the push switch according to Embodiment 2.
Figure 8A:
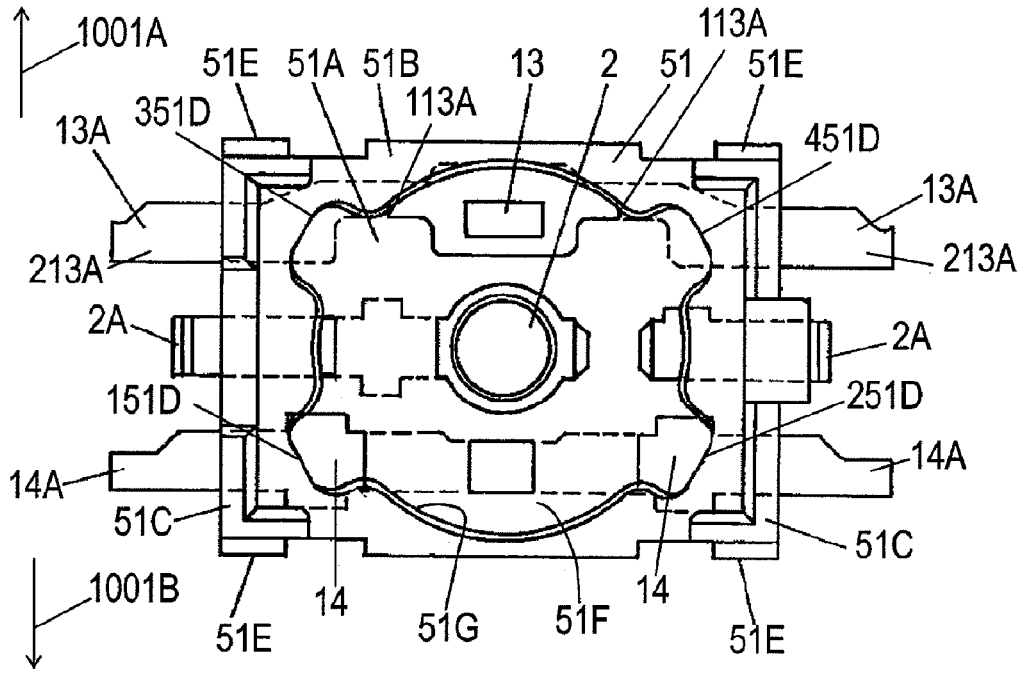
FIG. 8A is a top view of a case of the push switch according to Embodiment 2.
Figure 8B:
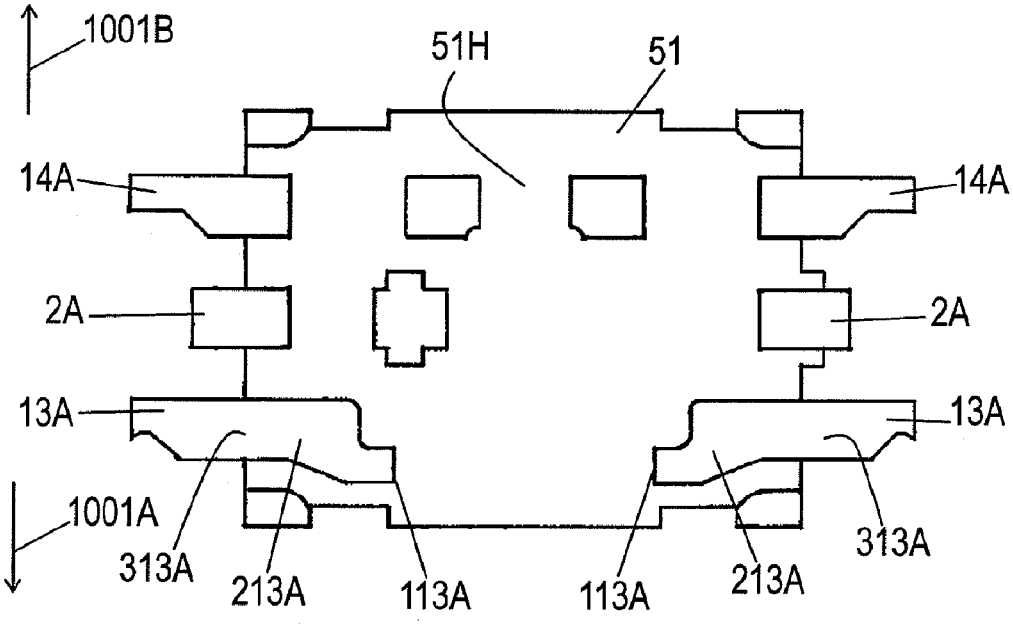
FIG. 8B is a bottom view of the case of the push switch according to Embodiment 2.

FIGS. 7A and 7B are a top view and an exploded perspective view of a push switch 1002 according to Exemplary Embodiment 2 of the present invention. The push switch 1002 includes an intermediate fixed contact 13, a peripheral fixed contact 14, and terminals 13A and 14A instead of the intermediate fixed contact 3, the peripheral fixed contact 4, and the terminals 3A and 4A of the push switch 1001 according to Embodiment 1. FIGS. 8A and 8B are a top view and a bottom view of a case 51 of the push switch 1002, respectively. In FIGS. 7A, 7B, 8A, and 8B, components identical to those of the push switch 1001 according to Embodiment 1 are denoted by the same reference numerals, and their description will be omitted.

The center fixed contact 2, the intermediate fixed contact 13, and the two peripheral fixed contacts 14 are exposed from the bottom surface 51F of the recess 51A of the case 51. The center fixed contact 2 is located at the center of the circular shape of the recess 51A as seen from above. The intermediate fixed contact 13 is located away from the center fixed contact 2 in the direction 1001A. The two peripheral fixed contacts 14 are located in pockets 151D and 251D provided in the inner side surface 51G of the recess 51A, respectively. The fixed contacts 2, 13, and 14 are electrically insulated from each other. The terminals 2A and 13A connected to the fixed contacts 2 and 13, respectively, extend out from the case 51 perpendicularly to the direction 1001A and in parallel with the bottom surface 51F of the recess 51A. The two terminals 14A connected to the fixed contacts 14 extend from the case 51 perpendicularly to the direction 1001A and in parallel with the bottom surface 51F of the recess 51A. Lower sides of the terminals 2A, 13A, and 14A are flush with the lower surface 51H of the case 51.

The terminals 14A extend downward from both ends of the peripheral fixed contact 14 exposed from the bottom surface 51F of the recess 51A, are exposed flush with the lower surface 51H of the case 51, and extend out from the case 51 perpendicularly to the direction 1001A and in parallel with the bottom surface 51F of the recess 51A. That is, each of the terminals 13A includes a portion 113A extending downward from the intermediate fixed contact 13 and a portion 213A extending from the portion 113A and outward from the case 51. The portion 113A extends downward from the intermediate fixed contact 13 and is exposed from the lower surface 51H of the case 51. The portion 213A of the terminal 13A has a lower side 313A flush with the lower surface 51H of the case 51. This arrangement allows the push switch 1002 to be surface-mounted onto a circuit board 2002 by soldering the lower surface 51H of the case 51 while the terminals 14A are joined securely on a large area, hence joining the push switch 1002 onto the circuit board 2002 with a large physical strength.

In the push switch 1002 according to Embodiment 2, the legs 15C and 25C of the lower movable contact 5 contact the peripheral fixed contact 14 in the pockets 151D and 251D which are closer to the operating portion 8A of the actuator 8 among the pockets 151D, 251D, 351D, and 451D are. The terminals 14A connected to the peripheral fixed contacts 14 are connected to a grounding circuit 2002A on the circuit board 2002 which provides a grounding potential. The movable contacts 5 and 6 are held at the grounding potential while the operating portion 8A is close to the grounding circuit 2002A. This arrangement prevents the circuit board from producing any malfunction or fault even if static electricity is applied to the operating portion 8A of the actuator 8 from an external source or an operator.

The arrangement of the center fixed contact 2, the intermediate fixed contact 13, the peripheral fixed contact 14, and the terminals 2A, 13A, and 14A of the push switch 1002 according to Embodiment 2 is just a reverse along the direction 1001A of the arrangement of the center fixed contact 2, the intermediate fixed contact 3, the peripheral fixed contact 4, and the terminals 2A, 3A, and 4A of the push switch 1001 according to Embodiment 1. The push switch 1002 activates two combinations of switch contacts similarly to the push switch 1001.

In the push switch 1002, the peripheral fixed contacts 14 are provided in the pockets 151D and 251D and on the bottom surface 51F of the recess 51A of the case 51. Alternatively, the peripheral fixed contact 4 of the push switch 1002 according to Embodiment 2 may be provided only in one of the pockets 151D and 251D but not in the other of the pockets.

Exemplary Embodiment 3

Figure 9:
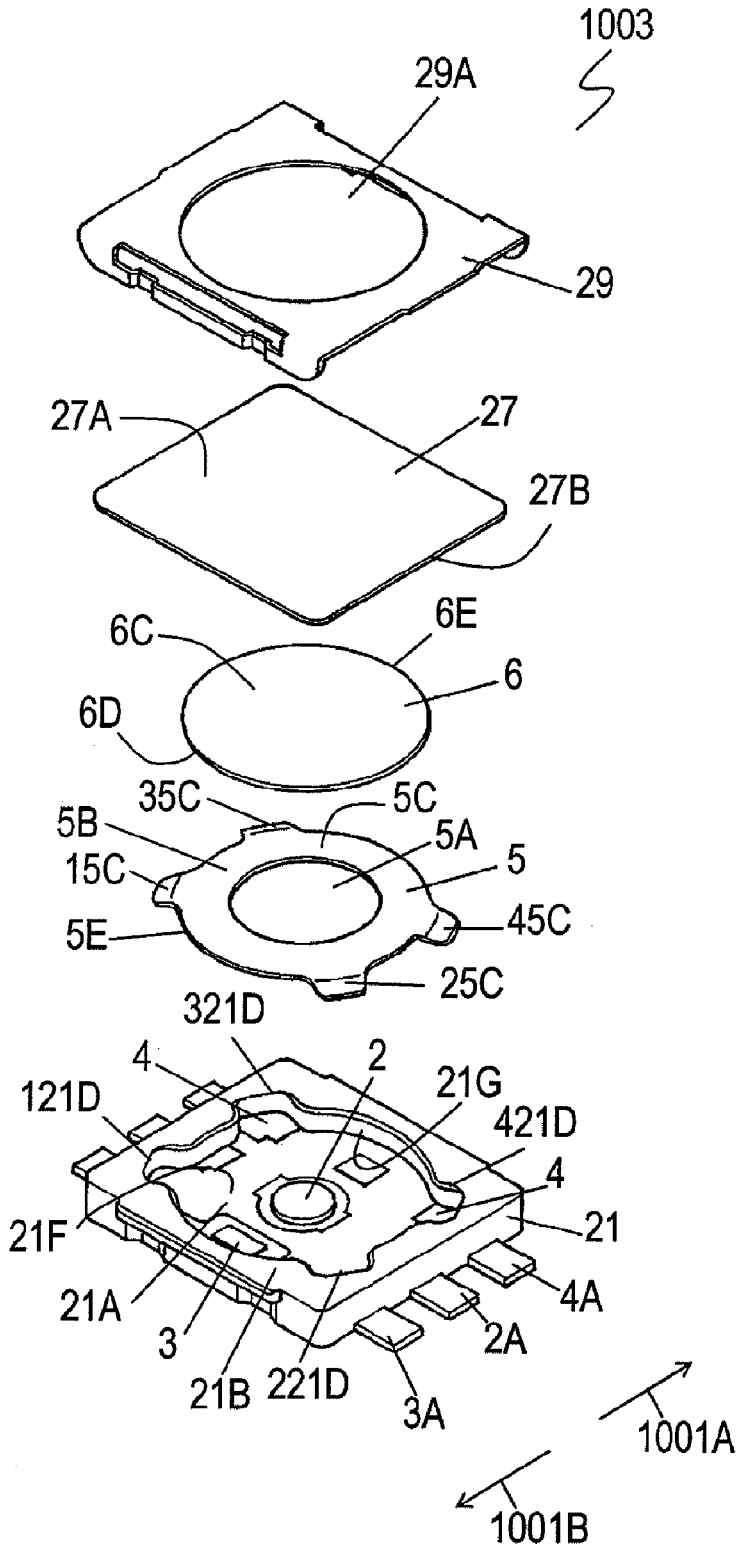
FIG. 9 is an exploded perspective view of a push switch according to Exemplary Embodiment 3 of the invention.

FIG. 9 is an exploded perspective view of a push switch 1003 according to Exemplary Embodiment 3 of the present invention. As shown in FIG. 9, components identical to those of the push switch 1001 according to Embodiment 1 are denoted by the same reference numerals, and their description will be omitted. The push switch 1003 according to Embodiment 3 does not include the actuator 8 of the push switch 1001 according to Embodiment 1 and includes a case 21, a protective sheet 27, and a cover 29 instead of the case 51, the protective sheet 7, and the cover 9 of the push switch 1001.

As shown in FIG. 9, the case 21 has a rectangular shape, as seen from above, having short sides in parallel to the direction 1001A and long sides perpendicular to the direction 1001A. The case 21 has a flat region 21B facing upward and has a recess 21A provided in the flat region 21B similarly to the case 51 of Embodiment 1. The recess 21A has a bottom surface 21F facing upward and an inner side surface 21G. Pockets 121D, 221D, 321D, and 421D extending toward four corners of the rectangular shape of the case 21 are provided in the inner side surface 21G. The center fixed contact 2, the intermediate fixed contact 3, and the two peripheral fixed contacts 4 are exposed from the bottom surface 21F of the recess 21A similarly to the recess 51A according to Embodiment 1. The two peripheral fixed contacts 4 are located in the pockets 321D and 421D, respectively. The lower movable contact 5 and the upper movable contact 6 are accommodated in the recess 21A, and covered from above with a protective sheet 27 which is bonded onto the flat region 21B to seal the recess 21A. A cover 29 is fixed to the case 21 from above the protective sheet 27. The cover 29 has an actuating opening 29A provided therein directly above the upper movable contact 6.

A user presses the upper surface 6C of the upper movable contact 6 of the push switch 1003 via the protective sheet 27 through the actuating opening 29A, and activating the first and second combinations of switch contacts. That is, the user presses the push switch 1003 not in the direction 1001A but from above to activate the first combination of switch contacts with a click feel and to activate the second combination of switch contacts with a click feel. The push switch 1003 according to Embodiment 3 has a small size along the direction 1001A, accordingly being mounted in a small area on a circuit board.

The push switch 1003 may not include the protective sheet 27. In this case, the push switch 1003 includes an actuator provided directly above the upper surface 6C of the upper movable contact 6 for pressing the upper movable contact 6 directly. The actuator may protrude from the cover 29 to allow the user to press down the actuator for activating the two combinations of the switch contacts.

In the push switch 1003, the two peripheral fixed contacts 4 are located in the pockets 321D and 421D, respectively, on the bottom surface 21F of the recess 21A of the case 21. Alternatively, the peripheral fixed contact 4 of the push switch 1003 of Embodiment 3 may be provided only in one of the pockets 321D and 421D but not the other of the pockets.

According to Embodiments 1 to 3, terms, such as "upper surface", "lower surface", "upward", "downward", "directly above", and "directly beneath", indicate the positional relationship between components of each of the push switches 1001, 1002, and 1003, and do not indicate an absolute direction, such as a vertical direction.

What is claimed is:

1. A push switch comprising:

a case made of insulating resin and having a surface facing upward;

a center fixed contact exposed from the surface of the case;

an intermediate fixed contact exposed from the surface of the case and located away from the center fixed contact;

a peripheral fixed contact exposed from the surface of the case and located away from the center fixed contact and the intermediate fixed contact;

a lower movable contact made of an elastic thin metallic plate, the lower movable contact including an annular portion having an annular shape having a circular hole provided therein and an outer edge having a circular shape, the circular hole being located directly above the center fixed contact, the annular portion having substantially a dome shape having an upper surface and a lower surface, the upper surface of the annular portion having a convex shape protruding upward, the lower surface of the annular portion having a concave shape, the annular portion facing the intermediate fixed contact via a space between the annular portion and the intermediate fixed contact, and a first leg, a second leg, a third leg, and a fourth leg extending downward and slantingly from the outer edge of the annular portion;

an upper movable contact made of an elastic thin metallic plate, the upper movable contact having substantially a dome shape having an upper surface and a lower surface, the upper surface of the upper movable contact having a convex shape protruding upward, the lower surface of the upper movable contact having a concave shape and facing the center fixed contact through the circular hole in the annular portion of the lower movable contact via a space between the upper movable contact and the center fixed contact, the outer edge of the upper movable contact being placed on the upper surface of the annular portion of the lower movable contact;

an actuator movable in a predetermined direction in parallel with the surface of the case, the actuator including an operating portion arranged to be pressed in the predetermined direction, an arm extending from the operating portion in the predetermined direction and having a distal end thereof, and a pressing portion provided at the distal end of the arm; and a cover including a top plate covering the actuator from above, and an inclining portion extending downwardly and slantingly from the top plate, the inclining portion having an inclining surface contacting the pressing portion of the actuator, wherein when the operating portion moves in the predetermined direction, the pressing portion of the actuator moves along the inclining surface of the inclining portion of the cover while causing the arm to deflect so as to press the upper surface of the upper movable contact downward, the third leg is placed on the peripheral fixed contact, the case has a rectangular shape having short sides in parallel with the predetermined direction and long sides longer than the short sides as seen from above, the first leg and the fourth leg of the first movable contact are symmetrical to each other with respect to a center of the annular portion as seen from above, the second leg and the third leg of the first movable contact are symmetrical to each other with respect to the center of the annular portion as seen from above, the first leg and the second leg of the first movable contact are symmetrical to each other with respect to a center axis which passes the center of the annular portion and which is parallel with the predetermined direction as seen from above, the first leg and the third leg of the first movable contact are located away from each other by an angular interval smaller than 90 degrees with respect to the center of the annular portion as seen from above, and the first leg, the second leg, the third leg, and the fourth leg of the lower movable contact are located within the width of the annular portion along the predetermined direction.

2. The push switch according to claim 1, wherein the case further includes a flat region facing upward, and a recess provided in the flat region and having a bottom surface facing upward, the surface of the case is the bottom surface of the recess, and the lower movable contact and the upper movable contact are accommodated in the recess of the case.

3. The push switch according to claim 2, further comprising a protective sheet made of insulating film, the protective sheet being fixed to the flat region of the case for sealing the recess, the protective sheet having an upper surface contacting the pressing portion of the actuator and a lower surface contacting the upper surface of the upper movable contact.

4. The push switch according to claim 1, wherein the operating portion of the actuator extends outward from the case in a direction opposite to the predetermined direction.

5. The push switch according to claim 1, wherein the actuator further includes a guide portion extending from the operating portion in the predetermined direction and being located away from the arm, the guide portion having a frame shape surrounding the arm.

6. The push switch according to claim 1, wherein the intermediate fixed contact is located in a direction opposite to the predetermined direction from the center fixed contact, and the third leg and the fourth leg of the lower movable contact are located in the predetermined direction from the first leg and the second leg, respectively.

7. The push switch according to claim 1, further comprising:

a first terminal connected to the center fixed contact and extending outward from the case;

a second terminal connected to the intermediate fixed contact and extending outward from the case; and a third terminal connected to the peripheral fixed contact and extending outwardly from the case.

8. The push switch according to claim 7, wherein the second terminal includes a first portion extending downward from the intermediate fixed contact and exposed from a lower surface of the case, and a second portion extending from the first portion and protruding from the case, the second portion of the second terminal having a lower surface flush with the lower surface of the case.

9. The push switch according to claim 7, wherein the intermediate fixed contact is located in the predetermined direction from the center fixed contact, the first leg and the second leg of the lower movable contact are located in the predetermined direction from the third leg and the fourth leg, respectively, and the second terminal includes a first portion extending downward from the intermediate fixed contact and exposed from a lower surface of the case, and a second portion extending from the first portion and protruding from the case, the second portion of the second terminal having a lower surface flush with the lower surface of the case.

* * * * *